US006574900B1

(12) United States Patent
Malley

(10) Patent No.: US 6,574,900 B1
(45) Date of Patent: Jun. 10, 2003

(54) O'MALLEY'S WEAPON AIMING SYSTEM

(76) Inventor: Paul Joseph Malley, 16 Strawberry Rd, Nelso, Townsville, Queensland (AU)

( * ) Notice: Subject to any disclaimer, the term of this patent is extended or adjusted under 35 U.S.C. 154(b) by 0 days.

(21) Appl. No.: 09/433,317

(22) Filed: Nov. 3, 1999

Related U.S. Application Data

(63) Continuation-in-part of application No. 09/093,083, filed on Jan. 29, 1998, now abandoned.

(51) Int. Cl.[7] ..... F41G 1/00

(52) U.S. Cl. ..... 42/130; 42/129; 42/122; 42/133

(58) Field of Search ..... 33/241, 243, 245; 42/130

(56) References Cited

U.S. PATENT DOCUMENTS

| | | | | | |
|---|---|---|---|---|---|
| 189,721 | A | * | 4/1877 | Freund | 33/245 |
| 1,088,137 | A | * | 2/1914 | Fidjeland | 33/246 |
| 2,807,981 | A | * | 10/1957 | Barnes | 33/245 |
| 3,744,133 | A | * | 7/1973 | Fukushima et al. | 42/129 |
| 3,908,282 | A | * | 9/1975 | Steffan | 33/234 |
| 3,948,587 | A | * | 4/1976 | Rubbert | 356/21 |
| 4,102,053 | A | * | 7/1978 | Colwell | 33/233 |
| 4,202,601 | A | * | 5/1980 | Burbo et al. | 350/159 |
| 4,380,876 | A | * | 4/1983 | Strassburg | 33/297 |
| 4,483,598 | A | * | 11/1984 | Leightner et al. | 350/558 |
| 4,616,421 | A | * | 10/1986 | Forsen | 33/233 |
| 4,632,547 | A | * | 12/1986 | Kaplan et al. | 356/247 |
| 5,365,670 | A | * | 11/1994 | Klimochko | 33/245 |
| 5,491,546 | A | * | 2/1996 | Wascher et al. | 356/4.03 |
| 5,561,563 | A | * | 10/1996 | Chestnut et al. | 359/823 |

* cited by examiner

*Primary Examiner*—Michael J. Carone
*Assistant Examiner*—Denise J Buckley
(74) *Attorney, Agent, or Firm*—Armstrong Teasdale LLP

(57) ABSTRACT

A weapon aiming device is disclosed which comprises a circular transparent and colored disk having a hole and a sleeve having a first and second end. The circular disk is configured to be mounted at a first end of the sleeve, and the second end of the sleeve is configured to fit over an eyepiece of a telescopic optical sight.

14 Claims, 2 Drawing Sheets

O'MALLEY'S WEAPON AIMING SYSTEM

CROSS REFERENCE TO RELATED APPLICATIONS

This application is a Continuation-in-Part of application Ser. No. 09/093,083 filed Jan. 29, 1998, now abandoned.

FIELD OF THE INVENTION

The present invention is directed to a device for enhancing the accuracy of a conventional single reticule telescopic sight.

BACKGROUND OF THE INVENTION

This invention relates generally to telescopic sighting and, more specifically to an improved telescopic sight for the aiming of weapons.

Normal optical (telescopic) sights have a single point of reference called a reticule (crosshairs) which the shooter has to align with the target. The problem with this is that the shooters eye has to be aligned along the centerline of the weapon whilst positioning the crosshairs on the target, therefore, the sight offers no help. In other words, shooters have to learn to keep their heads in the same position each time they aim, which of course is why it is so difficult to hit the target.

BRIEF SUMMARY OF THE INVENTION

This invention is a back sight which can be either a simple add on to an existing sight or alternatively mechanically incorporated into such a sight. The device enables the weapon to be aimed in a similar manner to one that has the normal iron foreword and back sights, though of course with much greater accuracy.

DETAILED DESCRIPTION OF THE INVENTION

Figure 1:
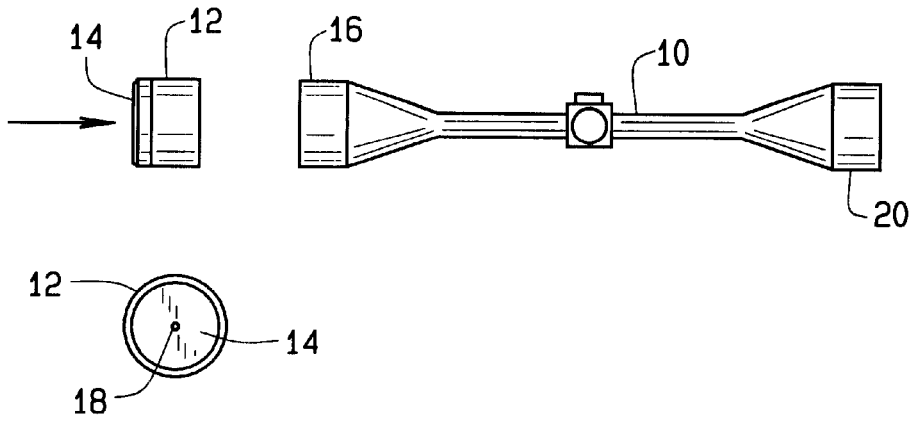
FIG. 1 is a view of the invention as an attachment to a normal telescopic sight.

This invention is essentially a surface with a discontinuity at its center placed some distance from but aligned with a reticule of a telescopic sight. Referring to FIG. 1 an optical sight item 10 (e.g a single reticule telescopic sight) is shown. Also shown is a flexible sleeve 12 into which is inserted a disk 14. Sleeve and disk 14 in combination form an assembly which may be pushed over an eyepiece 16 of sight 10 to form a complete unit. The disk and sleeve assembly, referred to herein as a weapon aiming device, or weapon sighting device, provides a second point of reference for a sight or aiming device that has only one point of reference. The single point of reference is sometimes referred to in the art as a principle focus point, and is ordinarily provided as a single reticule within the telescopic sight In one embodiment, disk 14 is fabricated from a suitably coloured transparent material with a hole 18 at a center of disk 14

In exemplary embodiments, disk 14 is placed between an observers eye (line of sight indicated by the arrow) and a reticule of sight 10, though by suitably arranging the optics of the sight any arrangemcnt is possible, for example placing the weapon aiming device over a second end 20 of sight 10.

The weapon aiming device may include a circular tinted disk 14 with a hole at its center placed at onc of a flexible sleeve 12. Sleeve 12 enables easy attachment to an optical or similar functioning sight 10. The tint may be of any color, however it has to be of sufficient intensity and contrast to the coloring of the attached sight system (e.g. sight 10) to enable the hole at its center to be visible and superimposed on the reticule of sight 10.

Diameter of hole 18 at the disk center should be optimized for the geometric shape of the symbol of the reticule (e.g. cross hairs). Alternatively, hole 18 could simply be an area of contact with the remaining area of disk 14, as long as there are sufficient conditions and difference in color between disk 14 and lenses incorporated within sight 10. In one exemplary embodiment, a diameter of approximately 1 mm is an expected order of magnitude for this hole or contrasting area.

The aiming device may include multiple disks 14, mounted in sleeve 12, one behind the other, each one being easily removable such that the overall transparency may be altered to better suit ambient light conditions. The multiple disks may incorporate different hole sizes such that removal of one or more may alter a size of the hole presented to a user of the aiming device. The aiming device may also include a number of optically polarized disks arranged such that their relative movement will effect their transparency. The aiming device may also include a disk made from a number of sections such that their relative movement will alter the size of the center hole.

The aiming device may also include an electrically active screen (e.g., liquid crystal display) such that its color and center hole can be varied. The hole 18 at the center would not necessarily be a physical hole in the screen, but simply an area of different aspect.

Figure 2:
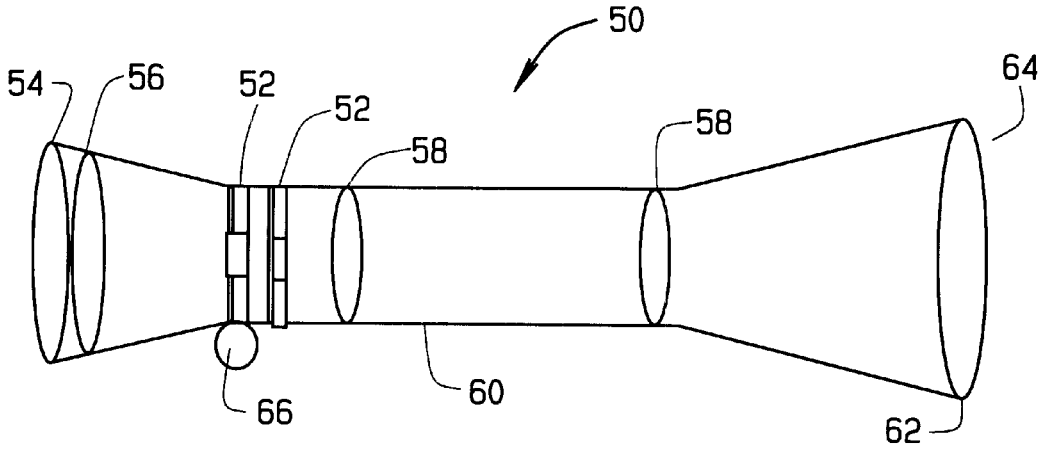
FIG. 2 is a diagramatic representation of the invention used internally as a second reticule in a telescopic sight.

The aiming device may form an integral part of an optical or similar functioning sight, rather than as a removable attachment as shown in FIG. 1. FIG. 2 illustrates a telescopic sight 50 which incorporates internal disks 52 to improve accuracy of sight 50. Disks 52 incorporate the same features as disks 14 (shown in FIG. 1). Disks 52 are fit into sight 50 between an eye piece lens 54 and reticule 56 and object lenses 58 which are located within collimator 60. Sight further includes a lens 62 at a forward facing end 64 of sight 50. Adjustment means 66 are used to ensure a center of disks 52 are aligned with reticule 56.

Disks 52 may include a number of holes which are positioned such that they align with elements of reticule 56 of sight 50, and hence assist the operator to more accurately align the two. Preferably, the hole (not shown in FIG. 2) at the center of disk 52 is sized and shaped so as to align with the shape of the reticule.

Figure 3:
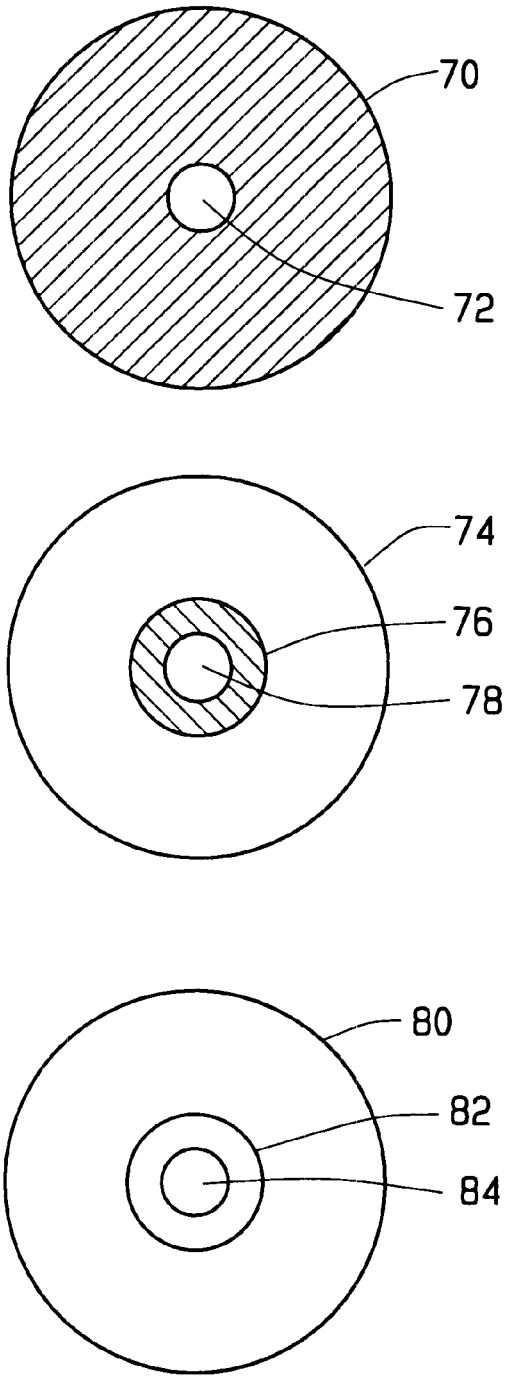
FIG. 3 shows a number of embodiments of transparent disks.

FIG. 3 illustrates a plurality of embodiments for disks 14 (shown in FIG. 1) and 52 (shown in FIG. 2). A coloured transparent disk 70 with a single hole 72 is shown. In another embodiment, a transparent disk 74 incorporates different aspect or coloured concentric circle 76 around a hole 78. Also a transparent disk 80 incorporates a transparent concentric circle 82 around hole 84.

Preferably, any of the above described disks mounted in sleeve 12 or in sight 50 arc configured such that when using a conventional single reticule optical sight, the concentric circles and/or the hole is superimposed upon the reticule. Furthermore, as a means for aligning the disk with the reticule, a reticule could be provided with a number of concentric circles in addition to the usual cross hairs. Therefore, it is easier for a user to accurately align the superimposed circle and the reticule circles so as to be concentric in comparison to the ability of a user to align the superimposed circle formed by the hole in the colored disk with the cross hairs of the optical sight.

The aiming device may also be used with an electronic sight which uses a liquid crystal display or a cathode ray tube for forming the reticule. While the invention has been described in terms of various specific embodiments, those skilled in the art will recognize that the invention can be practiced with modification within the spirit and scope of the claims.

what is claimed is:

1. A weapon sighting system for aiming a weapon at a target through an eyepiece of a telescopic optical sight, said sighting system comprising:

a circular, transparent, and colored disk having a hole; and a sleeve having a first and second end, wherein said circular disk is provided at said first end of said sleeve, and wherein said second end of said sleeve is configured to fit over the eyepiece of the telescopic optical sight.

2. The weapon sighting system according to claim 1, wherein sad hole is approximately 1mm in diameter.

3. The weapon sighting system according to claim 1, wherein said hole is configured to align with a reticule provided as the principle focus for the eyepiece of the sight.

4. The weapon sighting system according to claim 1, wherein said first end of is configured to receive a plurality of disks.

5. The weapon sighting system according to claim 1, wherein said circular disk comprises a plurality of optically polarized disks that are arranged such that their relative movement affects their transparency.

6. The weapon sighting system according to claim 1, comprising a plurality of said circular disks, each said disk incorporating a different diameter for said hole such that removal of one or more said disks alters a size of the hole presented to a user of said sighting system.

7. The weapon sighting system according to claim 1, wherein said circular disk comprises a concentric circle around said hole, said circle having a different color than a remainder of said circular disk.

8. A weapon sighting system for aiming a weapon at a target, said system comprising:

a telescopic optical sight having a single reticule provided as a principle focus of an eyepiece of said telescopic optical sight;

a circular transparent colored disk having a hole, said circular disk provided at an outer end of said telescopic optical sight, wherein said hole of said circular disk is generally aligned along a line of sight passing through said optical telescopic sight; and a sleeve having a first and second end, wherein said circular disk is provided at said first end of said sleeve, and wherein said second end of said sleeve is configured to fit over the eyepiece of said telescopic optical sight.

9. The weapon sighting system according to claim 8, wherein said hole is approximately 1mm in diameter.

10. The weapon sighting system according to claim 8, wherein said hole is configured to align with a reticule provided as the principle focus for the eyepiece of the sight.

11. The weapon sighting system according to claim 8, wherein said circular disk comprises a plurality of optically polarized disks that are arranged such that their relative movement affects their transparency.

12. The weapon sighting system according to claim 8, comprising a plurality of said circular disks, each said disk incorporating a different diameter for said hole such that removal of one or more said disks alters a size of said hole presented to a user of said sighting system.

13. The weapon sighting system according to claim 8, wherein said circular disk comprises a concentric circle around said hole, said circle having a different color than a remainder of said circular colored disk.

14. The weapon sighting system according to claim 8, wherein said hole is at a center of said circular disk.

* * * * *

UNITED STATES PATENT AND TRADEMARK OFFICE

CERTIFICATE OF CORRECTION

PATENT NO. : 6,574,900 B1
DATED : June 10, 2003
INVENTOR(S) : Paul Joseph Malley It is certified that error appears in the above-identified patent and that said Letters Patent is hereby corrected as shown below:

Title page, Item [54] and Column 1, line 1,
Delete "O'MALLEY'S".
After "AIMING" insert -- EYEPIECE --; so title reads:
-- WEAPON AIMING EYEPIECE SYSTEM --.

Title page,
Item [63], Related U.S. Application Data, change the Continuation-In-Part application number as follows: delete "09/093,083" and insert therefor -- 09/039,083 --.

Signed and Sealed this

Twenty-first Day of October, 2003

JAMES E. ROGAN
*Director of the United States Patent and Trademark Office*